United States Patent [19]

Wendt

[11] Patent Number: 4,698,946

[45] Date of Patent: Oct. 13, 1987

[54] INTERSECTING PARTITIONS ADAPTED TO SUPPORT CORNER-MOUNTED FURNITURE

[75] Inventor: Alan C. Wendt, Barrington, Ill.

[73] Assignee: USG Corporation, Chicago, Ill.

[21] Appl. No.: 734,677

[22] Filed: May 16, 1985

[51] Int. Cl.[4] ..... E04B 2/60

[52] U.S. Cl. ..... 52/275; 52/285; 52/729; 248/224.4; 248/243; 211/207

[58] Field of Search ..... 52/36, 729, 282, 278, 52/717, 718, 281, 275, 285, 732, 739, DIG. 6; 248/235, 224.4, 243; 211/90, 190, 207

[56] References Cited

U.S. PATENT DOCUMENTS

| | | | |
|---|---|---|---|
| 927,092 | 7/1909 | Bartelstone | 52/285 |
| 1,691,179 | 11/1928 | Betz | 52/285 |
| 2,476,506 | 7/1949 | Olsen | 52/DIG. 6 |
| 3,332,197 | 7/1967 | Hinkle | 52/732 |
| 3,566,561 | 3/1971 | Tozer | 52/729 |
| 3,782,048 | 1/1974 | Corman | 52/282 |
| 4,192,113 | 3/1980 | Martin, Jr. | 52/717.1 |
| 4,356,672 | 11/1982 | Beckman et al. | 52/36 |

FOREIGN PATENT DOCUMENTS

| | | | |
|---|---|---|---|
| 242429 | 11/1925 | United Kingdom | 52/285 |

*Primary Examiner*—John E. Murtagh
*Assistant Examiner*—Caroline D. Dennison
*Attorney, Agent, or Firm*—Robert M. Didrick; Samuel Kurlandsky; Robert H. Robinson

[57] ABSTRACT

Hang-on furniture supporting studs standing independently at the intersection of wallboard partitions are tied together by an intersection stud for proper orientation and stabilization.

7 Claims, 5 Drawing Figures

INTERSECTING PARTITIONS ADAPTED TO SUPPORT CORNER-MOUNTED FURNITURE

This invention relates to wallboard partitions adapted to support heavy loads mounted on brackets which are inserted into slotted standards fastened to studs in the partitions. It relates more particularly to partitions of that type which intersect. It relates still more particularly to a stud which connects such intersecting partitions so that they are accurately positioned.

In my co-pending, commonly assigned U.S. Pat. No. 4,570,390, filed Nov. 14, 1983, I disclose a stud having a web which is bifurcated successively to form first and second longitudinal channel housings in tandem along the edge of the stud. The first channel housing defines a screw-receiving groove and the second defines a channel adapted to nest a slotted standard. Flanges extending laterally from the bifurcated web are adapted to support the individual panels of a wallboard partition. The stud and standard combination provides an excellent system for supporting shelves and furniture.

Such studs are incorporated readily in easily relocated wallboard partitions which are often used when the floor plan of a building is likely to be changed rather often. Even though the partitions are easily dismantled and moved, it is often desired to make them more adaptable to changing uses by, for instance, making it possible to hang furniture from either of two intersecting partitions when the furniture is to be located at the intersection. It may even be desirable at times to hang such corner-filling furniture from both partitions at different levels. The furniture bearing studs at the corner of the intersecting partitions must be accurately and securely placed in relation to one another. Because of their open channeled structure for insertion of the cantilever brackets for shelves and on furniture modules, the corner studs, though angularly disposed to one another, do not meet. Nor do they receive the full benefit of orientation and stability conferred upon the remainder of each partition by the interlocking relationship of the panels and studs.

It is an object of this invention, therefore, to provide accurately placed and secure intersecting partitions adapted to support hang-on furniture modules and the like in the corner thereof. It is another object of this invention to provide a tying stud to align and brace the furniture bearing corner studs of intersecting partitions.

These and other objects which will become apparent from the following drawings and description of the invention are achieved by a construction system for intersecting partitions having a corner stud adapted to support cantilevered loads, said system comprising:

- a pair of separate corner studs set at an angle to one another, at least one of said studs having a web, a longitudinal bifurcated channel housing along an edge of the web, and flanges extending laterally from the channel housing; and
- a tying stud having a central web, an intermediate web extending at an obtuse angle from each longitudinal edge of the central web of the tying stud, and a flange extending from the longitudinal edge of each intermediate web and fastened to a corner stud.

Turning now to the drawings:

FIG. 1 is a perspective view, partially broken away, of a T-intersection of partitions adapted to support corner-fitting hang-on furniture and the like.

Figure 1:
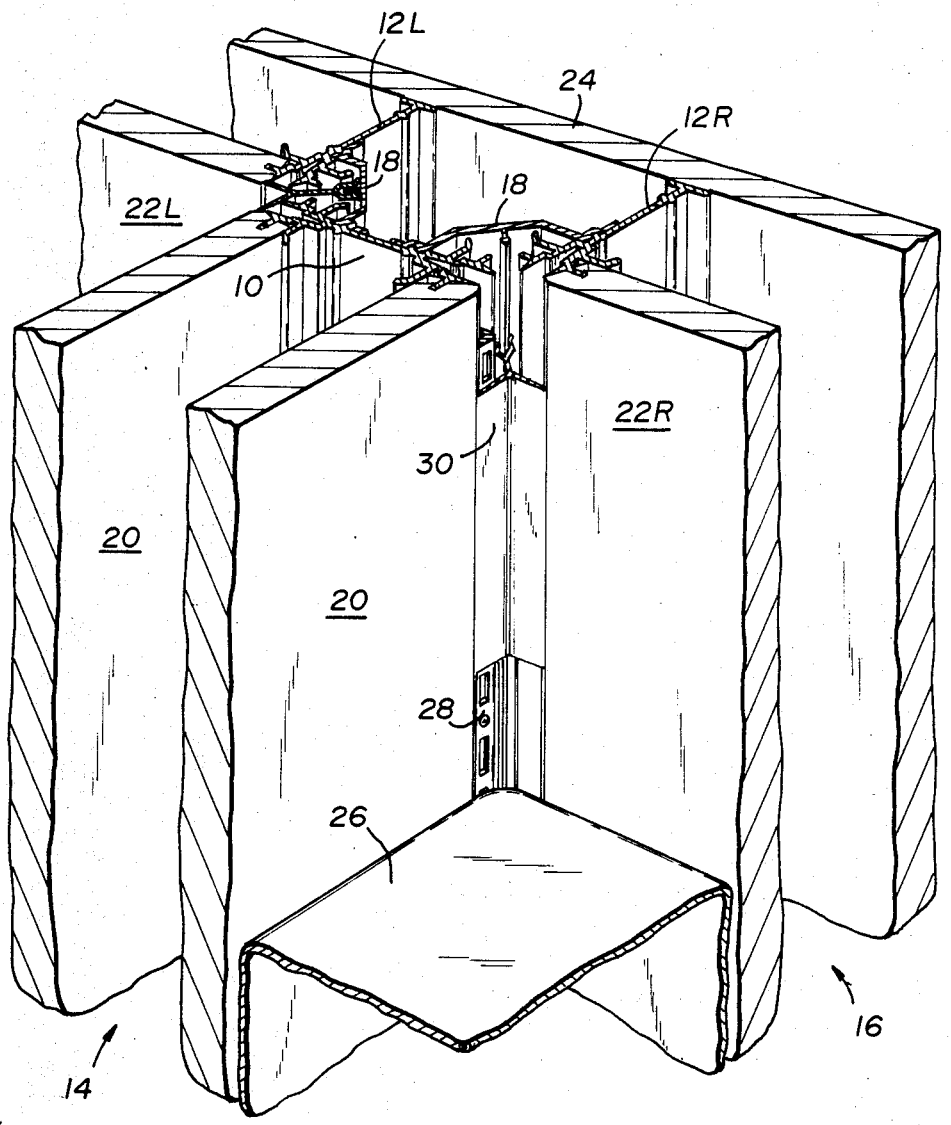

In FIG. 1, the corner studs 10, 12R, and 12L stand at the intersections of the partitions 14 and 16, which are tied together by the tying studs 18. The corner panels 20 are held upright by the stud 10 in partition 14 while the studs 12R and 12L hold the corner panels 22R and 22L, respectively, and brace the cross panel 24 in the partition 16. One end of the furniture module 26 is supported by the standard 28 which, in turn, is supported by the stud 10. The open channels of the studs 10 and 12R and the unused portion of the standard 28 are hidden by the trim piece 30.

Figure 2:
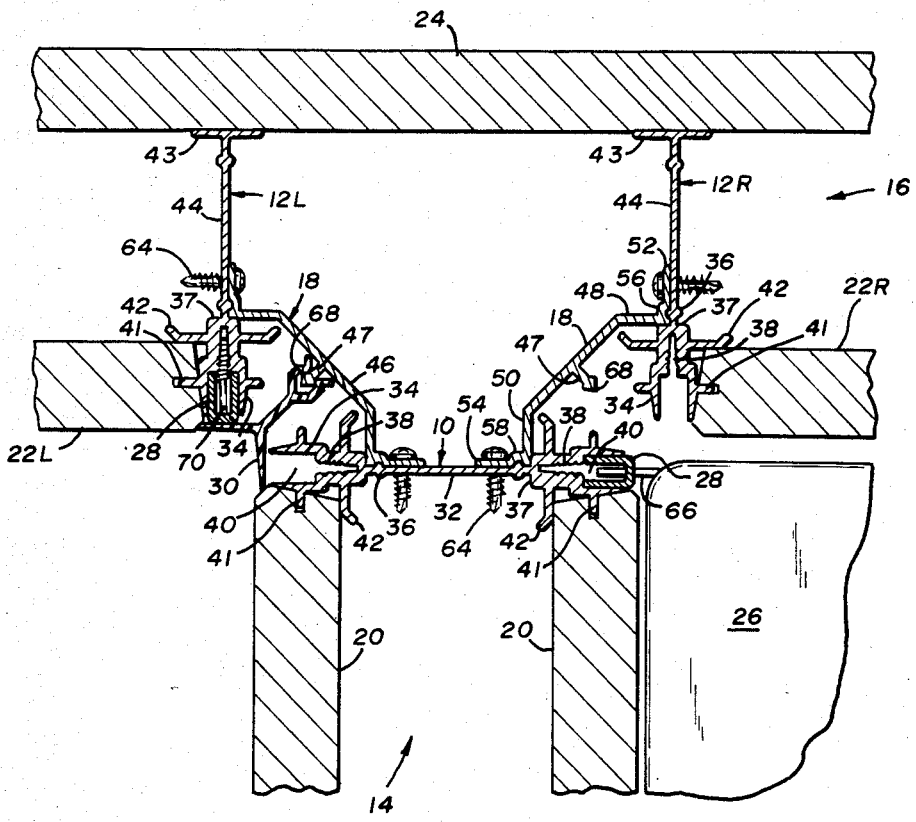
FIG. 2 is a plan view of the intersecting partitions of FIG. 1.

In FIG. 2, the corner stud 10 has the web 32, the channel housing 34 at each of the longitudinal edges of the web 32, and the longitudinal beads 36 which preferably are located from about 0.05" to about 0.2" (about 1 to 5 mm) from the base 37 of each channel housing 34. The channel housing 34 is bifurcated to define the screw-receiving groove 38 in tandem with the distal, unobstructed channel 40 in which the slotted standard 28 nests. The mouth of the U-shaped channel 40 is thus open to the frontal insertion or removal of the standard 28 after the partition, including the wallboard, has been erected. Extending bilaterally from the housings 34 are the kerf flanges 41 and the buttress flanges 42 which unilaterally engage the corner panels 20.

The corner studs 12R and 12L differ from each other only as to their location and their consequent mating with other parts of the partitions. Studs 12R and 12L differ from the stud 10 in that each has but one channel housing 34 and the T-flange 43 running longitudinally along the web 44. The kerf flange 41 and the buttress flange 42 of the stud 12R engage the corner panel 22R while their counterparts on the stud 12L engage the corner panel 22L. The T-flanges 43 brace the cross panel 24.

Figure 3:
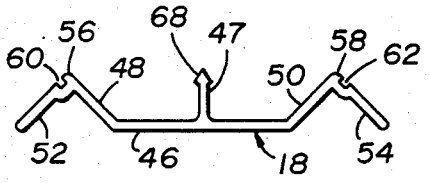
FIG. 3 is a plan view of a tying stud of this invention.

The tying stud 18 in FIGS. 2 and 3 has a central web 46, the barbed spline 47 normal to the web 46 and the two intermediate webs 48 and 50 which extend at an obtuse angle from opposite longitudinal edges of the central web 46. The flanges 52 and 54 meet their respective webs 48 and 50 at right angles to form the heels 56 and 58 in which the arch-like grooves 60 and 62, respectively, run longitudinally. The right angle orientation of the corner studs 10 and 12R is set accurately by fitting the heel 56 between the base 37 and the bead 36 on the right hand side of the stud 10 and the heel 58 between the base 37 and the bead 36 of the stud 12R. The orientation is secured by fastening the flanges 52 and 54 of the tying stud 18 to the webs 32 and 44, respectively, with the screws 64. In like manner, the corner studs 10 and 12L are secured in a right angle orientation. The furniture module 26 is supported at the right hand corner between the partitions 14 and 16 by insertion of the hooks 66 in the slots of the standard 28 which, in turn, is supported by the stud 10. The barb 68 on the spline 47 holds the corner trim piece 30 in place pending the time when one end of another furniture module or a shelf or the like is hung from the slotted standard 28 already fastened to the stud 12L by the screw 70 and others like it.

It will be recognized that the angle between the partitions may be greater or lesser than 90° and that, correspondingly, the angle between the intermediate webs of the tying stud and their respective flanges and the angle between the central web and the intermediate webs may vary independently or in concert. The intermediate webs may even be eliminated, leaving a central web which cuts diagonally or arcuately between two corner studs.

Figure 4:
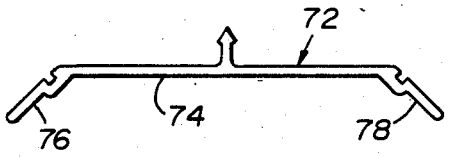
FIG. 4 is a plan view of another embodiment of the tying stud of this invention.
Figure 5:
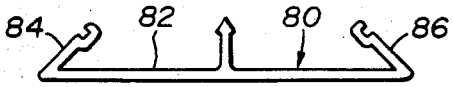
FIG. 5 is a plan view of yet another embodiment of the tying stud of this invention.

The tying stud 72 of FIG. 4, for example, has the central web 74 and the flanges 76 and 78 which extend outwardly from the web 74 at an obtuse angle. Another tying stud that may be substituted for the stud 18 in the partition system of FIGS. 1 and 2 is shown in FIG. 5. There the tying stud 80 has the central web 82 and the inwardly opposing flanges 84 and 86 which meet the web 82 at acute angles.

The trihedral web of FIG. 3 is preferred even over an arcuate one, however, because it uses less metal to accomplish its function. Also, unless a special inventory of corner studs with only a unilateral set of flanges 41 and 42 is kept, the straight central webs 74 of each tying stud must extend nearly to the center of the stud 10 in order to stand clear of the unoccupied flanges 41 and 42 of the studs 12L, 10, and 12R. Very little space would remain on the stud 10 for placement of the flanges 76 and 78 of the tying studs. One solution to that problem is the arrangement of the flanges 84 and 86 in FIG. 5.

The invention comprises the technical equivalents of the embodiments described herein as well as combinations thereof carried out according to the principles of the invention.

The subject matter claimed is:

1. A construction system for intersecting partitions said system comprising:

a pair of separate corner studs set at an angle to one another and spaced from one another, each stud having a web, at least one of said studs adapted to support cantilevered loads having a bifurcated channel housing along a longitudinal edge of the web, said web and channel housing having a common center line, said housing defining an unobstructed channel distal to the web and a screw-receiving groove proximate to the web which communicates with the channel, and flanges extending laterally from the channel; and a tying stud having a central web and a pair of flanges disposed at an angle from the vertical planes in which the longitudinal edges of the central web lie, each flange being fastened to the web of a corner stud.

2. The system of claim 1 wherein a slotted standard is nested within the channel and is fastened to the channel housing by a screw set within the groove.

3. The system of claim 1 wherein the channel housing of a corner stud has a base, a longitudinal bead along the web of the corner stud is spaced apart from the base, and a flange of the tying stud has a longitudinal groove which mates with the bead.

4. The system of claim 1 wherein the flanges of the tying stud are disposed at obtuse angles from said planes.

5. The system of claim 1 characterized further in that the tying stud has an intermediate web between the central web and each flange, each intermediate web extending at an obtuse angle from a longitudinal edge of the central web.

6. The system of claim 5 wherein the channel housing of a corner stud has a base, the web of said stud has a longitudinal bead spaced apart from the base of the channel housing, and a heel of the tying stud, formed by the intersection of an intermediate web and its associated flange, abuts the base of the channel housing.

7. The system of claim 6 wherein the heel of the tying stud has a longitudinal groove which mates with the bead of the corner stud.

* * * * *